United States Patent [19]

Peyre

[11] Patent Number: 4,664,005

[45] Date of Patent: May 12, 1987

[54] DEVICE FOR AUTOMATICALLY DISPENSING LABELS FROM A TAPE

[75] Inventor: Jacques Peyre, Paris, France

[73] Assignee: SHM Alcatel, Paris, France

[21] Appl. No.: 770,916

[22] Filed: Aug. 30, 1985

[30] Foreign Application Priority Data

Aug. 31, 1984 [FR] France ..... 84 13517

[51] Int. Cl.[4] ..... B65C 9/46; B26D 5/22

[52] U.S. Cl. ..... 83/205; 83/246; 83/283; 83/221; 83/231

[58] Field of Search ..... 83/203, 205, 240, 241, 83/246, 231, 283, 221

[56] References Cited

U.S. PATENT DOCUMENTS

| | | | |
|---|---|---|---|
| 271,835 | 2/1883 | Gilbert | 83/246 |
| 758,223 | 4/1904 | Thirsk | 83/246 |
| 841,834 | 1/1907 | Webber | 83/246 |
| 1,966,903 | 7/1934 | Piepenbring . | |
| 1,997,608 | 4/1935 | Swift . | |

FOREIGN PATENT DOCUMENTS

| | | |
|---|---|---|
| 194162 | 1/1908 | Fed. Rep. of Germany . |
| 2039685 | 1/1974 | France . |

*Primary Examiner*—Donald R. Schran

*Attorney, Agent, or Firm*—Sughrue, Mion, Zinn, Macpeak & Seas

[57] ABSTRACT

A device for automatically dispensing labels from a tape comprises a drive shaft and means for driving the tape intermittently from the drive shaft. These drive means comprise a tape feed shaft and a tape feed gearwheel coupled to this shaft. The device also comprises means for actuating the cutter from the drive shaft when the tape is stopped, in the form of a cutter actuator shaft and a cutter actuator gearwheel coupled to this shaft. A cylindrical drive member is coupled to the drive shaft and at least one toothed sector on the cylindrical drive member meshes with the tape feed and cutter actuator gearwheels in such a way that these gearwheels are driven one after the other.

9 Claims, 15 Drawing Figures

83
78
77
84
90
79
91
80
VI
96
X
IV
VIII
98
99
VII
IX
94
92
93
95

DEVICE FOR AUTOMATICALLY DISPENSING LABELS FROM A TAPE

BACKGROUND OF THE INVENTION

1. Field of the Invention

The present invention concerns devices for automatically dispensing labels from a tape feed roll, designed in particular for equipping franking machines.

2. Description of the Prior Art

In a manner known in particular from French patent No. 2 182 555, the franking tape may be initially incised, the segments between incisions constituting successive labels. The tape is then carried by a supporting strip from which the labels are readily detachable one after the other. In automatic label dispensers using this type of tape, the supporting strip is driven intermittently to bring the successive labels defined on the tape that it carries under the printing head; after printing of the labels a separator unit enables them to be readily separated from the supporting strip by imposing on the supporting strip a guide path having a sharp curvature.

The labels obtained from a tape of this kind are of a single length defined by the interval between the initial incisions in the tape. Thus they cannot be dimensioned at will for printing either a stamp only or a stamp accompanied by an advertisement, having just the necessary length in either case. Also, the cost of the franking tape itself, with which the supporting strip is associated, is relatively high.

To avoid these disadvantages it is known to form the franking labels from a continuous tape that has to be cut to suit the required label length. In dispensers using a franking tape of this kind, the tape is driven intermittently to expel a first or second required length of tape which is then cut by a cutter so that the successive labels are delivered for appropriate printing.

Two different cams selectively expel one or other length of tape as required according to the printing to be done defined by an external control member. This feeding of the tape over one of the required label lengths, achieved by selecting the cam assigned to the respective length to be expelled, produces a drive mechanism which is relatively complex and bulky.

An object of the present invention is to provide a device for dispensing labels from a continuous tape in which the tape feed mechanism is simpler and more reliable and provides for a higher throughput.

SUMMARY OF THE INVENTION

The present invention consists in a device for automatically dispensing labels from a tape, comprising a drive shaft, means for driving said tape intermittently from said drive shaft comprising a tape feed shaft and a tape feed gearwheel coupled to said tape feed shaft, a cutter, means for actuating said cutter from said drive shaft while said tape is stopped comprising a cutter actuator shaft and a cutter actuator gearwheel coupled to said cutter actuator shaft, a cylindrical drive member coupled to said drive shaft, and at least one toothed sector on said cylindrical drive member meshing with said tape feed and cutter actuator gearwheels whereby said gearwheels are driven one after the other.

Other objects and advantages will appear from the following description of an example of the invention, when considered in connection with the accompanying drawings, and the novel features will be particularly pointed out in the appended claims.

DESCRIPTION OF THE PREFERRED EMBODIMENT

Figure 1:
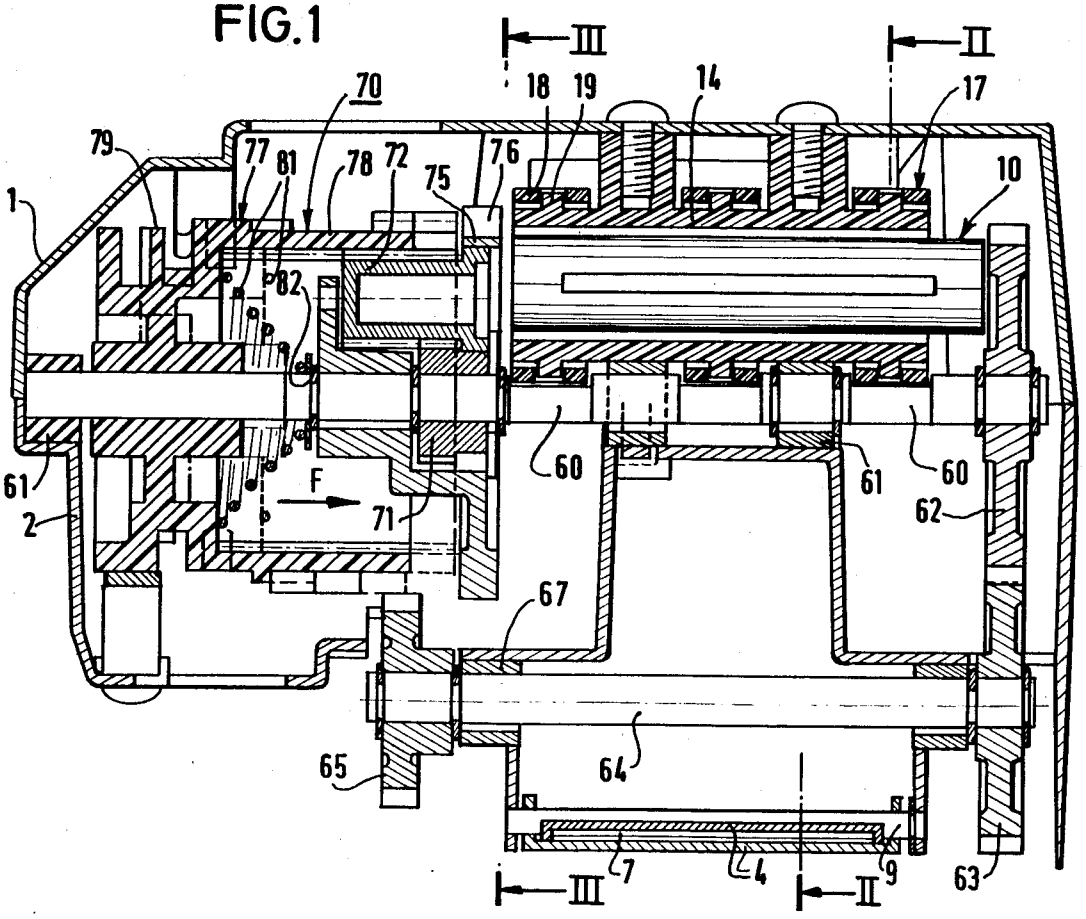
FIG. 1 is a view of the dispenser in accordance with the invention in longitudinal cross-section.
Figure 2:
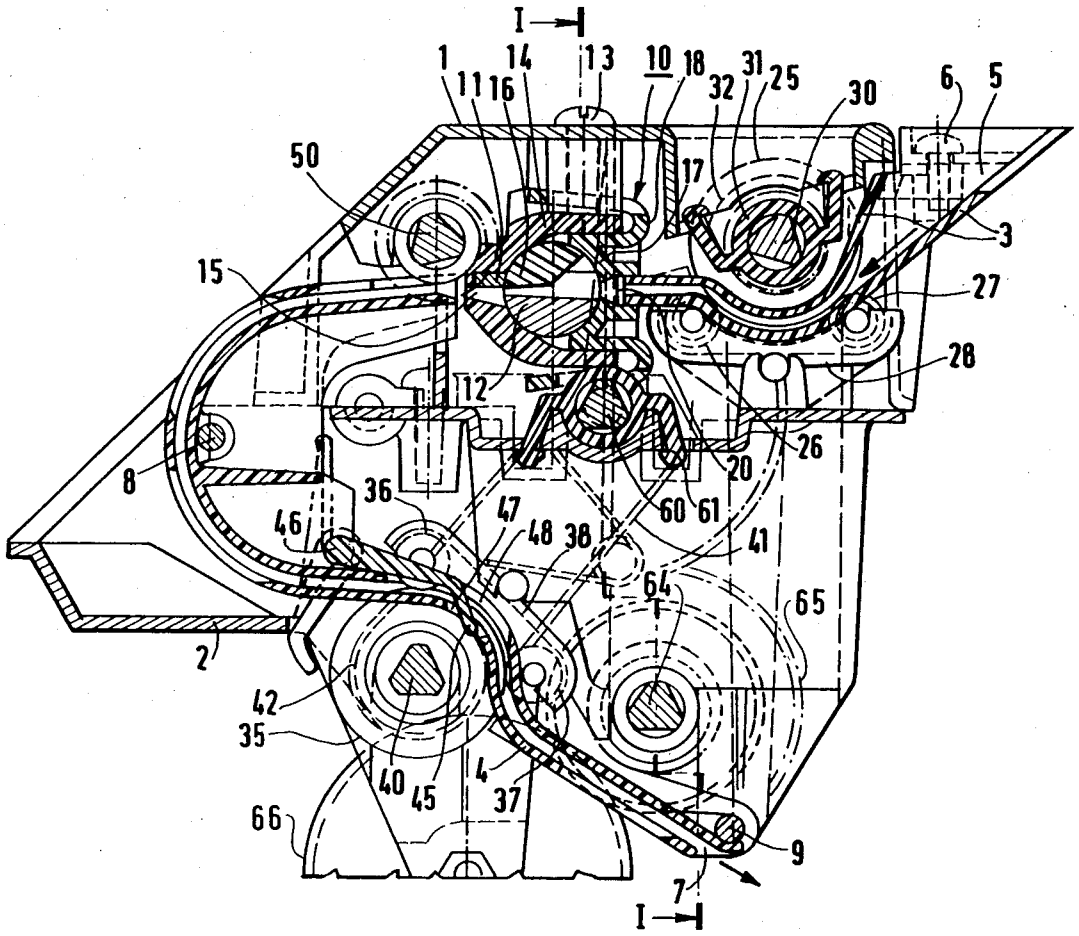
FIG. 2 is a view in cross-section on the line II—II in FIG. 1 showing the part of the dispenser for feeding and cutting the tape, constituting the tape feed path for the removal of labels, the line I—I in FIG. 2 representing the cross-section plane of FIG. 1.
Figure 3:
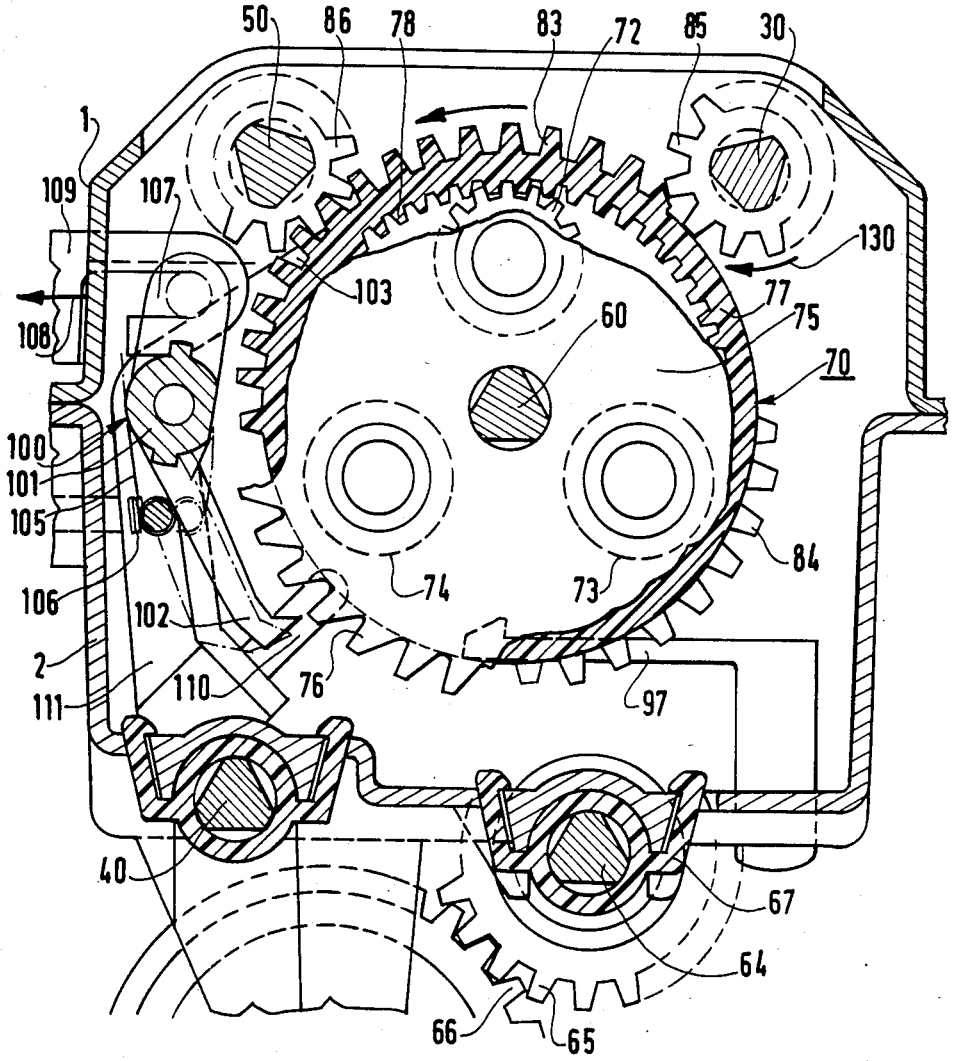
FIG. 3 is a view in cross-section on the line III—III in FIG. 1 showing the control part of the dispenser.
Figures 4, 5, 6, 7, 8, 9, 10:
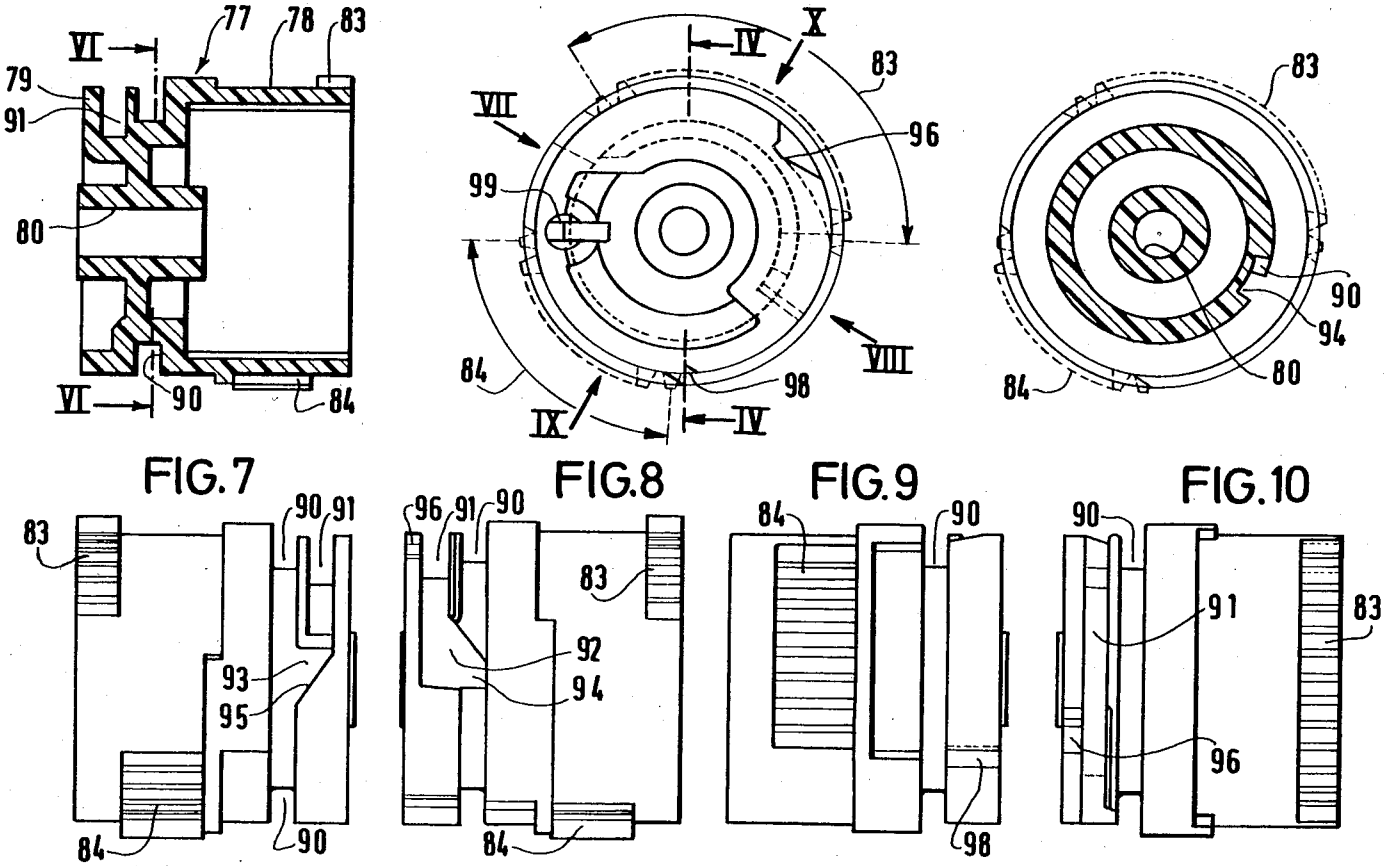
FIGS. 4 through 10 are various views showing one of the control mechanism components of the dispenser, FIG. 4 showing this component in cross-section on the line IV—IV in FIG. 5, FIG. 5 showing it from the front, FIG. 6 showing it in cross-section on the line V—V in FIG. 4 and FIGS. 7 through 10 respectively showing it in cross-section on the lines VII—VII, VIII—VIII, IX—IX and XX—XX in FIG. 5.

Referring to FIG. 1, it is seen that the label dispenser essentially comprises two parts, one to the right in this figure which defines a tape feed path for removing successive labels, shown in FIG. 2, and the other to the left in this figure which defines the dispenser control mechanism, shown in FIG. 3 in particular. These two parts of the dispenser are mounted in a frame in the general form of two half-shells 1 and 2 fastened together.

In FIG. 1, and more especially in FIG. 2, it is seen that the tape feed path is defined by two rigid chutes 3 and 4. The chute 3 defines on the upper half-shell 1 of the frame a tape inlet 5, being fixed to the half-shell 1 at the level of this inlet 5 by screws 6. The chute 4 defines on the lower half-shell 2 of the frame a label outlet 7, retaining pins 8 and 9 engaged in fastening lugs provided on this chute and on this half-shell fixing it to the half-shell 2. The two chutes 3 and 4 are curved so as to occupy in the righthand part of the dispenser substantially the same height and width as the frame.

The other two ends of the chutes 3 and 4 are linked within the frame by a cutter 10 with fixed blade 11 and mobile blade 12 disposed between them. This cutter 10 is secured by screws 13 to the upper half-shell 1 of the frame. Its fixed blade 11 is mounted on a support 14 which is U-shaped in cross-section, its semi-circular bottom featuring an opening 15 under the fixed blade 11 for the tape to pass through. Its mobile blade 12 is of semi-circular cross-section; it is fixed to the ends of a support 16, leaving a gap between it and its support over the length of the opening 15. This blade 12 and its support 16 form an assembly pivotally mounted in the support 14 and an auxiliary support 17 with fastening lugs 18 which engage snap-fastener fashion over outwardly projecting pegs on the sides of the U-shaped support 14.

This support 17 also features an opening 20 in line with the opening 15 for the tape to pass through.

Drive means feed the tape and the labels along this feed path. These means comprise, on the part of the path defined by the chute 3, a roller 25 on one side of this chute and two pressure rollers 26 and 27 on the other side of the chute, this roller and these pressure rollers intercepting the tape path through appropriate openings (not shown) in the walls of the chute, in order to feed the tape.

The roller 25 is constrained to rotate with a transmission shaft 30 fixed by bearings 31 forming fastening rings to the upper half-shell 1 of the frame. The two pressure rollers 26 and 27 are feely rotatable on a support cradle 28 secured elastically to the lower half-shell 2 in order to apply them against the roller 25.

The drive means further comprise, on the part of the tape path defined by the chute 4, a roller 35 and two associated pressure rollers 36 and 37 disposed on respective sides of the chute and cooperating through appropriate openings (not shown) in the chute to feed labels cut from the tape. The roller 35 and the pressure rollers 36 and 37 are mounted in an analogous manner to the preceeding assembly. The roller 35 is constrained to rotate with a transmission shaft 40 which carries it, fixed by bearings (not shown) forming fastening rings to the lower half-shell 2 of the frame. The two pressure rollers 36 and 37 are freely rotatable on a support 38 secured elastically to the lower half-shell in order to apply them against the roller 35.

The two shafts 30 and 40 carrying the rollers 25 and 35 which feed the tape and the labels are coupled to one another. The coupling means are shown in dashed line in FIG. 2 as in the dispenser they lie in front of the cross-section plane of this figure. They comprise a notched belt 41 running between a notched pulley wheel 42 at the end of the shaft 40 and another notched pulley wheel 32 at the end of the shaft 30, for transmitting motion from one shaft to the other.

In line with the roller 35 the feed path defined by the chute 4 is blocked by a finger 45 which retracts when pressed on by the end of the tape. This finger 45 is mounted parallel to the chute on an arm 46. In the absence of tape (FIG. 2) the curved end of this finger passes through aligned openings 47 and 48 provided in the walls of the chute 4, forming a retractable obstacle on the tape path. The length of the feed path between the cutter 10 and this finger 45 is equal to a first selected label length.

A shaft 50 mounted on the upper half-shell in the immediate vicinity of the cutter 10 by bearings or fastening rings (not shown) operates the cutter 10, as will be described later with reference to FIG. 14.

The shaft 50 operating the cutter and the shafts 30 and 40 feeding the tape and the labels are driven from a central main drive shaft 60 by the control mechanism (FIGS. 1 and 3). The shaft 60 is secured by bearings or fastening rings 61 to the lower half-shell 2. It has at one end a gearwheel 62 meshing with a first end gearwheel 63 on an auxiliary shaft 64 itself driven by a second gearwheel 65 at its other end driven from a driving toothed wheel 66. These gearwheels 62 and 63 on the one hand and the gearwheel 65 and the driving wheel 66 on the other hand are on respective sides of the feed path defined by the chutes and the cutter in the dispenser, the driving wheel projecting externally of the half-shell 2 and being shown in part only in FIG. 2. Bearings or fastening rings 67 secure the shaft 64 to the lower half-shell.

The control mechanism of the dispenser is shown in the lefthand part of FIG. 1 and FIG. 3. This mechanism is mounted on the central shaft 60 and constitutes a differential 70. It comprises an input planet wheel 71 constrained to rotate with the shaft 60, three satellite wheels 72, 73 and 74 driven by the input planet wheel, a satellite carrier 75 with a peripheral toothed ring 76, and an output planet wheel 77.

This output planet wheel is described with reference to FIGS. 1 and 3 and also with reference to FIGS. 4 through 10 which show it separately in various elevation and cross-sectional views.

The output planet wheel 77 is a generally cylindrical part of which one portion forms an internally toothed cage 78 engaged over the peripheral teeth of the set of three satellite wheels 72 through 74 and the other or front portion 79 of which constitutes an extension to the cage 78 on the side opposite the satellite wheels and closes same. This front part 79 features an axial passage 80 accommodating the shaft 60, the planet wheel 77 being free to rotate on the shaft 60. This output planet wheel 77 is movable on the shaft 60 for greater or lesser engagement with the satellite wheels, as shown by the arrow F in FIG. 1, against the action of a spring 81 trapped between the back of the cage and a circlip 82 fitted to the shaft in front of the input planet wheel 71 and the set of satellite wheels.

The part forming the cage 78 over the satellite wheels has two toothed sectors 83 and 84 at its periphery; these toothed sectors are in substantially diametrically opposed positions relative to one another and are offset axially relative to one another, the sector 83 more outwardly on the cage 78, opposite the front part 79, being longer, and the other sector 84, on the same side as the front part 79, being wider. Two gearwheels 85 and 86 on the shafts 30 and 50, respectively (FIG. 3) mesh with one or both of these toothed sectors to drive these shafts from the output planet wheel 77 (FIGS. 13 and 14), as will be explained hereinafter.

The output planet wheel 77 has on its front part 79 a peripheral groove 90 which is partially flanked, over a length slightly greater than that of the toothed sector 84, by an auxiliary groove 91. The auxiliary groove 91 is offset towards the end of the front part 79 and is the same width as and slightly deeper than the groove 90. The two grooves 90 and 91 communicate with one another through two openings referred to as the inlet opening 92 and the outlet opening 93 of the groove 91, these openings being formed in the separating wall between the grooves at the ends of the groove 91. A notch 94 in the bottom of the groove 90 extends slantwise through the inlet opening 92 into the bottom of the groove 91, at the same level. This notch constitutes a switch for selective entry into the groove 90 or the groove 91 of a finger forming part of an external mechanism 100 which is described hereinafter. At the level of the outlet opening 93 an inclined surface 95 effects a transition between the outside flanks of the two grooves, constituting a guide for exit movement of the aforementioned finger from the groove 91 into the groove 90 via the opening 93.

The front part 79 also has a notch 96 at its end and on its periphery, a claw forming part of the aforementioned mechanism 100 cooperating with this notch 96 by engaging in it to lock the output planet wheel 77 against rotation in a so-called idle position. A pawl 97 fixed to the lower-shell 2 of the frame and extending under the end of the front part 79 of the output planet wheel cooperates with a small cut-out 98 in the periphery of this end of the front part, being engaged in the cut-out 98 when the output planet wheel 77 is locked against rotation in its idle position. This pawl 97 constitutes with its cut-out a non-return system when the output planet wheel starts to rotate on disengaging the claw from its notch 96. This small cut-out 98 is shaped to avoid any interaction with the claw cooperating with the notch 96, the latter also being shaped to prevent any interaction with the pawl 97.

In the front surface of the front part 79 there is provided a housing 99 for accommodating a magnet (not shown). A Hall effect sensor mounted on the lower half-shell behind the terminal bearing 61 fastening the shaft 60 to the frame (FIG. 3) and therefore not visible cooperates with this magnet to sense the arrival of the output planet wheel in its idle position and consequently starting of rotation of the output planet wheel 77 as soon as the aforementioned claw is disengaged from its notch 96.

Figure 11:
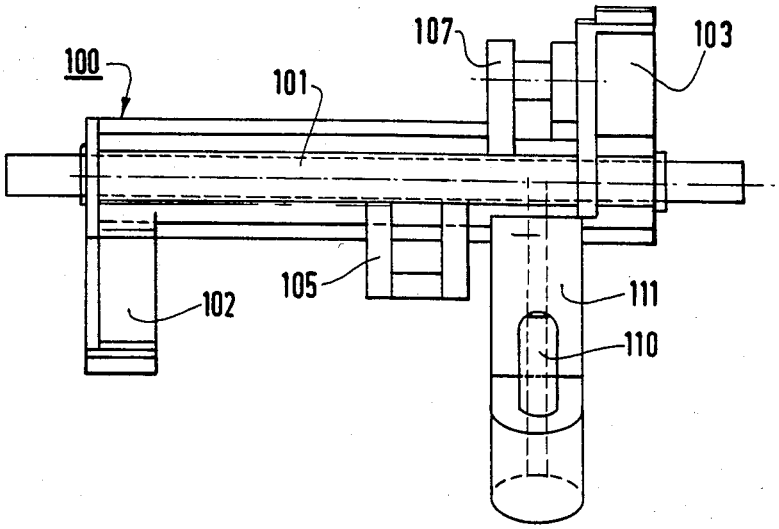
FIGS. 11 and 12 are two views, one from the side and the other from the front, of another control mechanism component of the dispenser.
Figure 12:
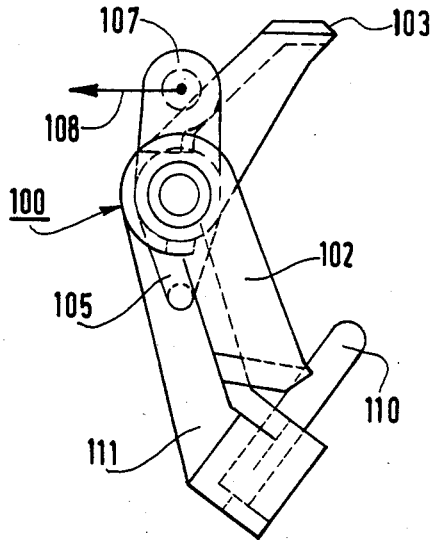

The external mechanism 100 associated with the differential 70 is described with reference to FIG. 3 and FIGS. 11 and 12 which show it separately seen from in front and from the side.

This mechanism 100 consists of an arm 101 extending along the differential 70 with which it is associated to constitute a clutch. It is mounted on the lower half-shell 2 by end bearings analogous to those securing the shafts such as the shaft 64. This arm features, facing the toothed ring 76 at the periphery of the satellite carrier, a first claw 102 and, at the opposite end, facing the end of the front part, a second claw 103 facing the end of the front part 79. The two claws 102 and 103 are disposed on the arm 101 in substantially symmetrical fashion so that when the claw 103 is engaged in its notch 96 (FIG. 5) on the output planet wheel 77, the claw 102 is simultaneously disengaged from the teeth of the ring 76 of the satellite carrier 75, and vice versa, to lock against rotation one of these two elements 75 and 77 of the differential 70 and consequently unlock the other element.

This arm also features a first retaining lever 105 between the end of which and the lower half-shell 2 is attached a spring 106 operative in tension (FIG. 3). Because of the action of this spring the end of the claw 103 bears on the periphery of the front part 79 of the output planet wheel and drops into the notch 96 as soon as it is lined up with the end of this claw, so as to then lock the output planet wheel. Correspondingly, the claw 102 is engaged with the teeth of the ring 76 of the satellite carrier which it locks against rotation for as long as the claw 103 is not in its notch 96, and is then released from it as soon as the claw 103 is in its notch 96.

To disengage the claw 103 from its notch 96 the arm 101 carries a small operating lever 107. This operating lever 107 is actuated in the direction of the arrow 108 FIG. 3 by a solenoid, of which only the end of a connection 109 to the lever has been shown in FIG. 3 to avoid overcomplicating the figure.

The same arm 102 also carries the aforementioned finger 110 which is engaged in the groove 90, or the groove 91 which partially flanks it, of the output planet wheel 77, to control its displacement relative to the satellite wheels. This finger 110 is mounted at the end of a support 111 which extends on the arm 101 on the same side as and substantially parallel to the claw 102. The claw 103 and the finger 110 on its support are relatively disposed between them on the shaft 101 (FIGS. 11, 12) in corresponding relationship with the relative disposition of the notch 96 for locking in the idle position and the notch 94 for switching between the grooves 90 and 91 on the part 79 of the output planet wheel 77 (FIG. 8), for which when the claw 103 is in its notch 96, that is to say when the output planet wheel is locked, the switching notch 94 is just in front of the finger 110 and the latter is fully engaged in the groove 90.

The action of the aforementioned solenoid on the operating lever 107 controls the switching of the finger 110 to keep it in the groove 90 or to move it into the groove 91 to provoke displacement in the direction of the arrow F (FIG. 1) of the output planet wheel 77 on the shaft 60 and therefore relative to the satellite wheels, during rotation of the output planet wheel. For a first short period for which this solenoid is energized, sufficient for the claw 103 to exit from its notch and permit rotation of the output planet wheel, the claw 103 is released against the periphery of the output planet wheel. Given these conditions, for this first short energization time, the finger 11, when in line with the switching notch 94, takes up a high position in this notch to remain engaged in the groove 90, beyond the notch 94. For a longer second period for which the solenoid is energized, greater than the time needed for the notch to pass under the finger, the claw 103 remains lifted away from the periphery of the output planet wheel beyond the passage of the switching notch 94 under the finger 110. Given these conditions, the finger 110 assumes a low position in the switching notch 94, being firmly applied against its bottom, to be guided through the opening 92 into the auxiliary groove 91, that is to say the passage of the finger 110 from the groove 90 to the auxiliary groove 91 which provokes the displacement of the output planet wheel on the shaft 60 and relative to the satellite wheels between two defined positions spaced by the distance between the median axes of the grooves.

Figure 13:
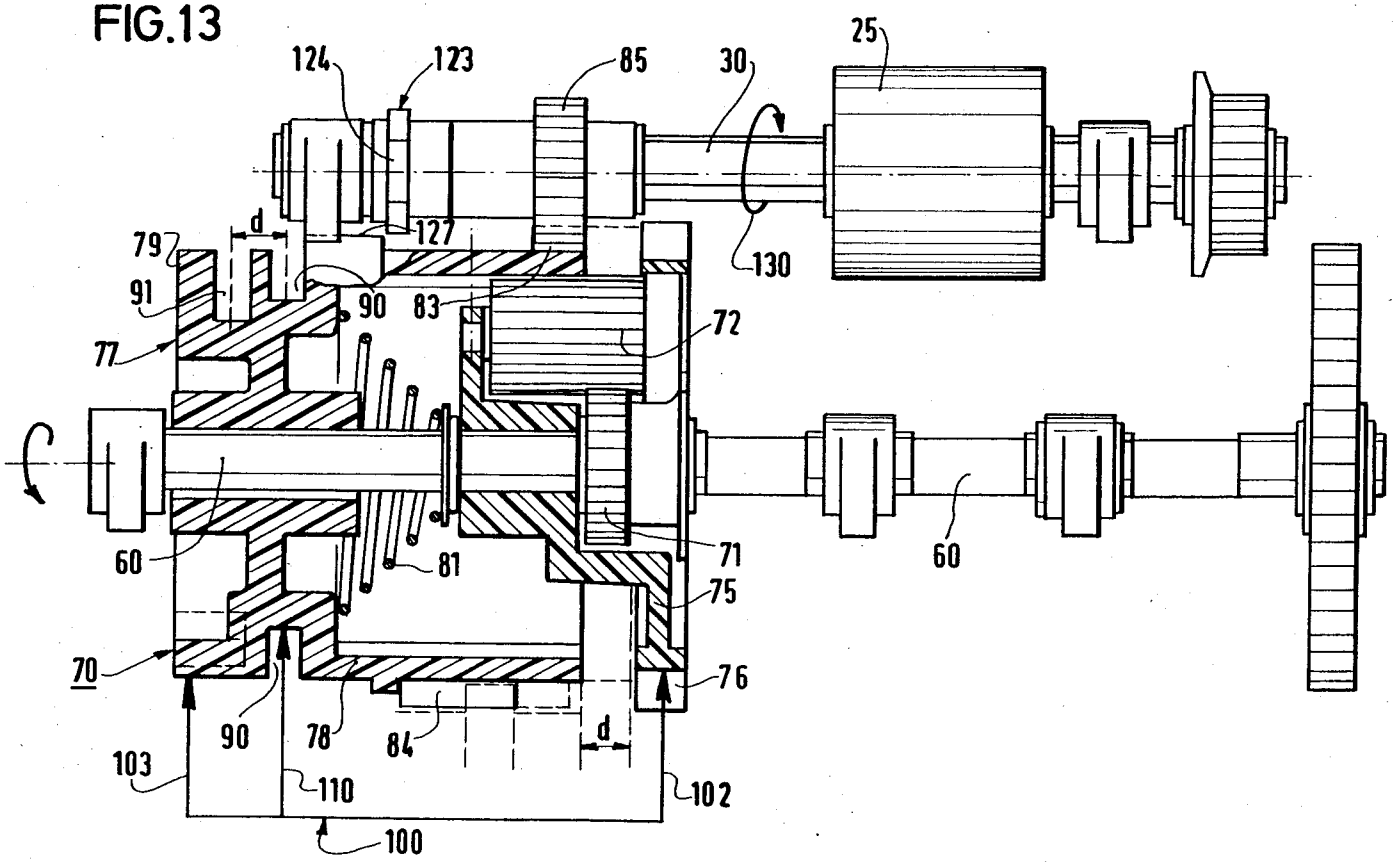
FIGS. 13 and 14 respectively show the tape feed and cutter actuator control mechanism in the dispenser.

FIG. 13 shows separately the part of the dispenser control mechanism which feeds the tape. The tape is fed by the roller 25 mounted on the shaft 30 the gearwheel 85 of which is driven by the output planet wheel 77. There are also symbolically represented by arrows marked with the reference numbers of the components to which they correspond in the mechanism 100 associated with the differential the control inputs applied to the differential by the mechanism 100 for transmission of rotation from the shaft 60 to the output planet wheel 77, on immobilization of the satellite carrier 75, and for positioning the output planet wheel on the shaft 60. There is also shown the possible displacement d of the output planet wheel 77 relative to the satellite wheels such as 72 on routing the finger 110 into the groove 91, corresponding to the offset between the median axes of the grooves 90 and 91.

Thus if for a complete revolution of the output planet wheel 77 the finger 110 is held in the groove 90, the gearwheel 85 meshes only with the peripheral toothed sector 83. The rotation of the roller 25 through an angle corresponding to the length of the toothed section 83 feeds the tape by a so-called short first defined length. On the other hand, if during a complete revolution of the output planet wheel 77 the finger 110 is engaged in the groove 91 and then the groove 90, the gearwheel 85 meshes successively with the toothed sector 84 and then the toothed sector 83, by virtue of the displacement d of the output planet wheel relative to the satellite wheels and thus along the shaft 30 which it causes, as schematically represented by the positions of the output planet wheel shown in dashed line and in full line. These two consecutive rotations of the roller 25, corresponding to the lengths of the toothed sectors 83 and 84, feed the tape in two stages by a so-called long second defined label length.

With reference to FIG. 13, note also the presence of the shaft 30 of a stabilizer disk 123 with concave peripheral facets 124 facing a peripheral shoulder 127 on the output planet wheel 77. This shoulder 127 is laterally profiled, facing the toothed sectors 83 and 84, to constitute a bearing surface for the stabilizer disk only when the gearwheel 85 is not meshing with one or other of the toothed sectors 83 and 84 so as to guarantee that the shaft 30 will not be rotated by any vibration or other impulses which might be transmitted to the shaft 30.

Figure 14:
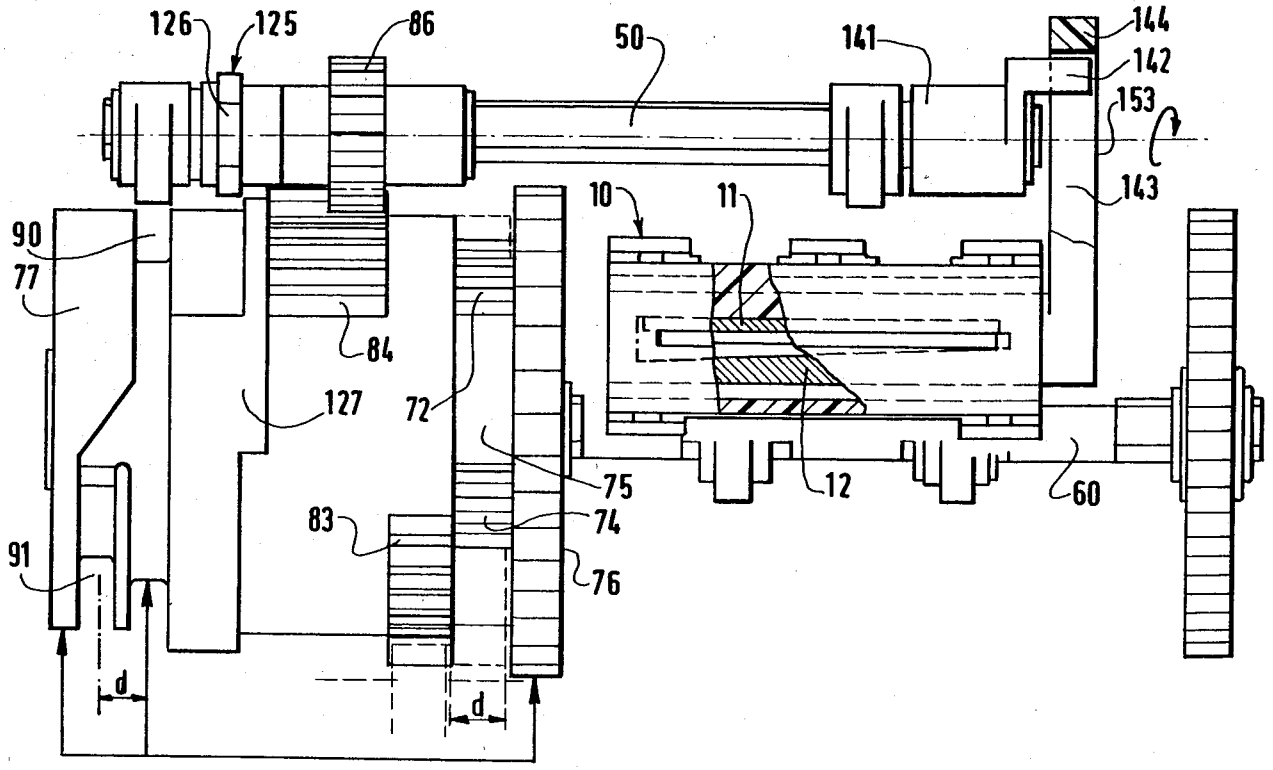

FIG. 14 shows separately the part of the mechanism actuating the cutter 10. There are also symbolically represented by arrows carrying the reference numbers of the corresponding components the control inputs applied by the mechanism 100, and by d the possible displacement of the output planet wheel 77 relative to the satellite wheels. The cutter is actuated from the shaft 50 the gearwheel 86 on which is driven by the toothed sector 84 on the output planet wheel 77, which is sufficiently wide to mesh with the gearwheel 86 whatever the position of the output planet wheel on the shaft 60, as a result of the action of the finger 110 in the groove 90 or the groove 91. There is also shown the linkage between this shaft 50 and the movable blade 12 of the cutter 10, which constitutes a crankshaft-crank assembly. This linkage is formed by an end ring 141 on the shaft 50 with an eccentric tenon 142 engaged in an oblong opening 143 of a link 144 commanding reciprocation of the movable blade 12 in front of the fixed blade 11 of the cutter on each complete revolution of the shaft 50 as a result of the meshing of its gearwheel 86 with the entire length of the toothed sector 84.

In FIG. 14 note also the presence on the shaft 50 of a stabilizer gearwheel 125 with concave peripheral facets 126 facing the aforementioned shoulder 127. This stabilizer gearwheel 125 bears on the shoulder 127 when the gearwheel 86 is not meshed with the toothed sector 84, to guarantee that the shaft 50 does not rotate other than when the gearwheel 86 meshes with the toothed sector 84.

Figure 15:
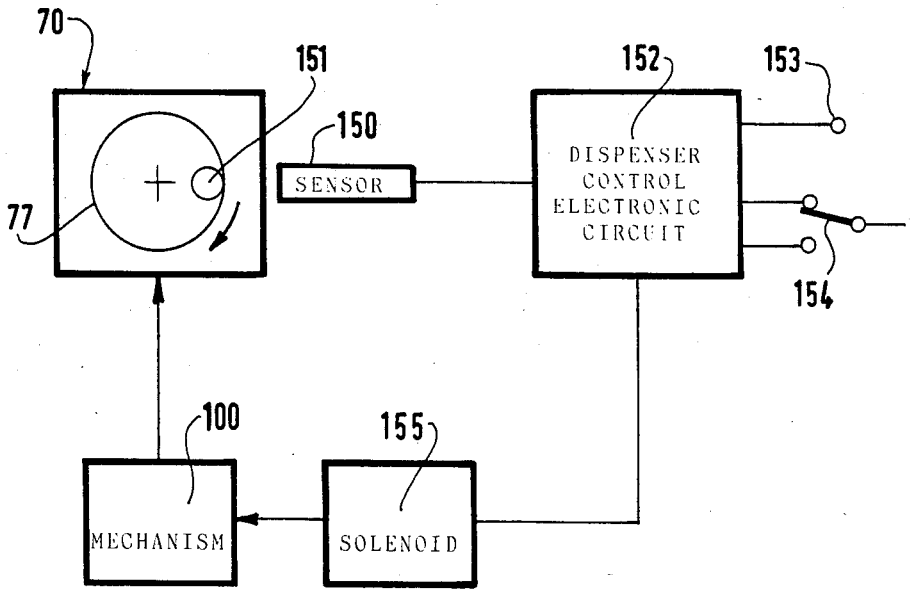
FIG. 15 shows the block schematic for the electrical control system of the dispenser as shown in the previous figures.

FIG. 15 shows a block schematic of the electronic control circuit of the dispenser. It comprises the Hall effect sensor 150 fixed to the frame of the dispenser and cooperating with the magnet 151 mounted at the end of the front part of the output planet wheel 77 of the differential 70, with which it is rotated. A dispenser control electronic circuit 152 is connected to the sensor 150. It also receives from a first external input 153 a signal commanding output of a label and from a second external input, schematically represented by a 2-position switch 154, a signal for selecting output of short or long labels.

This control circuit 152 is connected to the aforementioned solenoid 155 controling the mechanism 100, to energize it in response to the label output control signal and, in order to select the short or long time of energization, the signal selecting output of long or short labels. The circuit 152 is also conditioned by the signal detecting commencement of rotation of the output planet wheel delivered by the sensor 150 in response to the passage of the magnet 151.

The operation of the dispenser to deliver labels is achieved in successive cycles each initiated by the signal on the control input 153. Each cycle takes place during one revolution of the output planet wheel commanded from the shaft 60 which is driven continuously.

In response to the signal to output a label, the energization of the solenoid 155 unlocks the output planet wheel 77, locks the satellite carrier 75 and inserts the finger 110 into the groove 90 on the upstreamside of the switching notch 94. Commencement of rotation of the output planet wheel, at virtually the same time, is detected by the passage of the magnet 151 past the sensor 150.

To deliver a short label, to which corresponds the short energization time for the solenoid 155, the release of the solenoid causes the claw 103 to fall back onto the periphery of the output planet wheel and raises the finger 110 when the switching notch 94 passes, to keep it in the groove 90. During the displacement of the finger 110 in the end of the part of the groove 90 duplicated by the groove 91 and the beginning of the part of the groove 90 not duplicated by the groove 91, the gearwheel 86 meshes with the toothed sector 84 to drive the shaft 50 and actuate the cutter.

To deliver a long ticket, to which corresponds the long energization time of the solenoid 155, the finger 110 is in the low position when the switching notch passes. It is then routed into the groove 91 and causes displacement of the cage of the output planet wheel relative to the satellite wheels. During the movement of the finger 110 along the groove 91, initially the gearwheel 85 meshes with the toothed sector 84 and drives the shaft 30 carrying the tape feed roller 35, then immediately afterwards the gearwheel 86 meshes with the toothed sector 84 and drives the shaft 50 operating the cutter.

During the movement of the finger 110 along the part of the groove 90 not duplicated by the groove 91, the toothed sector 83 and the gearwheel 85 mesh together and the roller 25 feeds the tape.

The end of the cycle is defined by the claw 103 dropping into its notch 96 on the periphery of the output planet wheel, locking the output planet wheel and unlocking the satellite carrier, at which time the toothed sector 83 and the gearwheel 85 are no longer meshed together.

Each of the cycles may therefore be subdivided into the following stages starting from unlocking of the output planet wheel.

To deliver a short label, each cycle begins by cutting the tape followed by feeding the tape by the length of a short label, for the next cycle. To deliver a long label, each cycle gives rise to a supplementary feeding of a length of tape corresponding to the difference in length between long and short labels, followed by cutting the tape, and then feeding the tape by the length of a short label, for the next cycle.

It will be understood that various changes in the details, materials and arrangements of parts which have been herein described and illustrated in order to explain the nature of the invention may be made by those skilled in the art within the principle and scope of the invention as expressed in the appended claims.

There is claimed:

1. Device for automatically dispensing labels from a tape, comprising; a drive shaft, means for driving said tape intermittently from said drive shaft comprising a tape feed shaft and a tape feed gearwheel coupled to said tape feed shaft, a cutter operatively positioned relative to said tape, means for actuating said cutter from said drive shaft while said tape is stopped comprising a cutter actuator shaft, a cylindrical drive member coupled to said drive shaft, and at least one toothed sector on said cylindrical drive member meshing with said tape feed and cutter actuator gearwheels whereby said gearwheels are driven one after the other, said cylindrical drive member comprising two toothed sectors in substantially diametrically opposed relationship offset axially and circumferentially on its periphery, without overlapping one another, and at least one of said two sectors meshing with said tape feed gear wheel and the other of said toothed sectors meshing with said cutter actuator gearwheel.

2. Device according to claim 1, wherein said cylindrical drive member is part of a differential mounted on said drive shaft and further comprising a clutch and an external label dispensing control member adapted to operate said clutch to couple said drive shaft to said cylindrical drive member.

3. Device according to claim 2, wherein said cylindrical drive member incorporates means for disabling said clutch on each complete revolution of said cylindrical drive member for an idle position of said cylindrical drive member.

4. Device according to claim 1, wherein said cylindrical drive member is adapted to move between two defined positions facing said tape feed and cutter actuator gearwheels and one of said toothed sectors is of sufficient width to mesh successively with said tape feed and cutter actuator gearwheels for one of said defined positions of said cylindrical drive member.

5. Device according to claim 4, wherein said cylidnrical drive member comprises a first peripheral groove, a second peripheral groove partially flanking said first peripheral groove, a wall separating said grooves, an inlet opening and an outlet opening at the ends of said second groove in said wall separating said grooves whereby said first and second peripheral grooves are in communication, and said device further comrpising a finger inserted in said first groove to control displacement of said cylindricla drive member and an external ticket length selector to operate on said finger when facing said inlet opening to either retain it in said frist groove or move it into said second groove.

6. Device according to claim 5, wherein said first and second grooves are of different depths, the less deep groove having on its bottom a transverse notch leading via said inlet opening into the other of said grooves, constituting a selector switch for routing said finger into one or other of said grooves.

7. Device according to claim 1, further comprising stabilizer gearwheels respectively operatively associated with said tape feed and cutter actuator gearwheels and wherein said cylindrical drive member has a profiled shoulder at its periphery against which said stabilizer gearwheels bear when the associated gearwheel is not meshed with one of said toothed sectors.

8. Device according to claim 2, further comprising a solenoid operating said clutch and controled by said external label dispensing control member.

9. Device according to claim 5, further comprising a solenoid operating said finger and controlled by said external label length selector.

* * * * *